US007878169B2

(12) United States Patent
Brinks

(10) Patent No.: US 7,878,169 B2
(45) Date of Patent: Feb. 1, 2011

(54) CAM ROLLER PIN WITH TRANSVERSE GROOVES

(75) Inventor: Barry T. Brinks, Fort Collins, CO (US)

(73) Assignee: Woodward Governor Company, Fort Collins, CO (US)

( * ) Notice: Subject to any disclaimer, the term of this patent is extended or adjusted under 35 U.S.C. 154(b) by 633 days.

(21) Appl. No.: 11/422,456

(22) Filed: Jun. 6, 2006

(65) Prior Publication Data

US 2007/0277763 A1 Dec. 6, 2007

(51) Int. Cl.
*F01L 1/14* (2006.01)

(52) U.S. Cl. ..... 123/90.48; 123/90.44; 123/90.55; 464/160

(58) Field of Classification Search ..... 123/90.16, 123/90.39, 90.44, 90.48, 90.52, 90.6, 90.5, 123/90.45, 90.46, 90.55, 90.54, 90.34, 90.35; 74/559, 567, 569
See application file for complete search history.

(56) References Cited

U.S. PATENT DOCUMENTS 2,094,019 A * 9/1937 Notter ..... 74/519
2,601,830 A * 7/1952 Berlyn et al. ..... 91/488
3,190,613 A * 6/1965 Embree ..... 254/215
4,708,102 A 11/1987 Schmid
5,797,364 A 8/1998 Meek et al.
6,216,583 B1 * 4/2001 Klinger et al. ..... 92/129
7,017,884 B2 * 3/2006 Brinks et al. ..... 251/129.11

FOREIGN PATENT DOCUMENTS

DE 29919375 U1 * 1/2000
JP 2001317430 A * 11/2001

* cited by examiner

*Primary Examiner*—Ching Chang
(74) *Attorney, Agent, or Firm*—Reinhart Boerner Van Deuren, P.C.

(57) ABSTRACT

A roller pin for carrying a cam roller in a tappet assembly is provided. The roller pin providing reduced run in time and reduced peak and localized contact pressure between the cam roller and roller pin. The roller pin comprises a substantially cylindrical shaft having a length, a first end and a second end. The length extends from the first end to the second end. The shaft includes a plurality of grooves axially spaced apart and extending in a direction being transverse to the length. The plurality of grooves located proximate the first and second ends and extending only partially the circumference of the shaft.

15 Claims, 8 Drawing Sheets

CAM ROLLER PIN WITH TRANSVERSE GROOVES

FIELD OF THE INVENTION

The present invention relates generally to rollers and roller pins, and more particularly to cam rollers and cam roller pins.

BACKGROUND OF THE INVENTION

Many cam driven piston type pumps use tappet assemblies for pumping fluid. A tappet assembly includes a cam roller that is rotatably mounted on a roller pin. Typically, the cam roller follows an outer periphery of a rotating eccentric camshaft of the pump. The eccentric peripheral shape causes the cam roller to be actuated in a cyclical motion away from and towards the camshaft as it rotates. As the cam roller is cyclically actuated, the motion is translated to a plunger. During one portion of a pumping cycle, fluid is drawn by the plunger movement into a pumping chamber. During the second portion of the pumping cycle, the plunger pumps the fluid out of the chamber. Such tappet assemblies are known in the art.

In pumps such as high pressure pumps, the cam roller is exposed to extremely high loading. The high loading on the cam roller imposes a bending moment on the roller pin carrying the cam roller, thereby causing the roller pin to bend. Specifically, the roller pin bends over the entire length of the interface between the cam roller and the roller pin. The cam roller, however, does not bend at the edges of the interface between the cam roller and the roller pin because there is no bending moment at the roller ends. The bending of the roller pin without corresponding bending of the cam roller creates an imperfect and non-uniform contact area between the cam roller and roller pin. As a result, non-uniform contact pressure is applied at the edges of the contact area. Near the edges of the contact area, the contact pressure can be extremely high, as illustrated in FIG. 12, which is a graph of the contact pressure along the axial length of cam roller/roller pin interface of cam rollers and roller pins of the current art. This abnormal contact pressure near the edges of the contact area causes the cam roller to be overloaded and causes localized damage and wear to the inside diameter of the cam roller and outside diameter of the roller pin.

Current designs often require a "run-in" period during which the pump is ran to control the roller pin initial wear rate to reduce the non-uniformity between the roller pin and cam roller, and thereby reduce high end load pressures. To further reduce the effect of this problem and reduce the length of the run-in period, roller pins have been manufactured from softer metals such as bronze. The use of softer metals reduces the amount of run-in required because of the increased local wear rate and lower strength of the softer metals. Under the high contact pressure near the ends of the cam roller, the use of softer metals results in an increased rate of wear on the roller pin, thereby reducing the overall operating life of the tappet assembly before repair is required.

BRIEF SUMMARY OF THE INVENTION

The present invention provides a roller pin that may be manufactured from stronger, more durable materials without increasing wear on a carried cam roller by reducing localized contact pressure between the roller pin and a carried cam roller. In an embodiment of a roller pin of the present invention run-in time between the cam roller and roller pin is significantly reduced or all-together eliminated. To provide such a roller pin, the roller pin includes a plurality of grooves that allow for localized bending to improve the contact and interface between the cam roller and the roller pin.

In another embodiment, the invention provides a roller pin for carrying a cam roller in a tappet assembly. The roller pin comprises a substantially cylindrical shaft having a length, a first end and a second end. The shaft further including a plurality of grooves axially spaced apart and extending in a direction being transverse to the length. The plurality of grooves located proximate the first and second ends and extending only partially the circumference of the shaft.

In another embodiment, the invention provides a tappet assembly for use in a pump. The tappet assembly comprises a tappet having a first roller pin mount and a second roller pin mount. Each of the first and second roller pin mounts having a receiving hole. The tappet assembly further including a roller pin. The roller pin inserted within the receiving holes. The roller pin including a plurality of axially spaced apart grooves that extend in a transverse direction relative to a length of the roller pin. The grooves extending only partially around the circumference of the roller pin. The roller carried on the roller pin.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
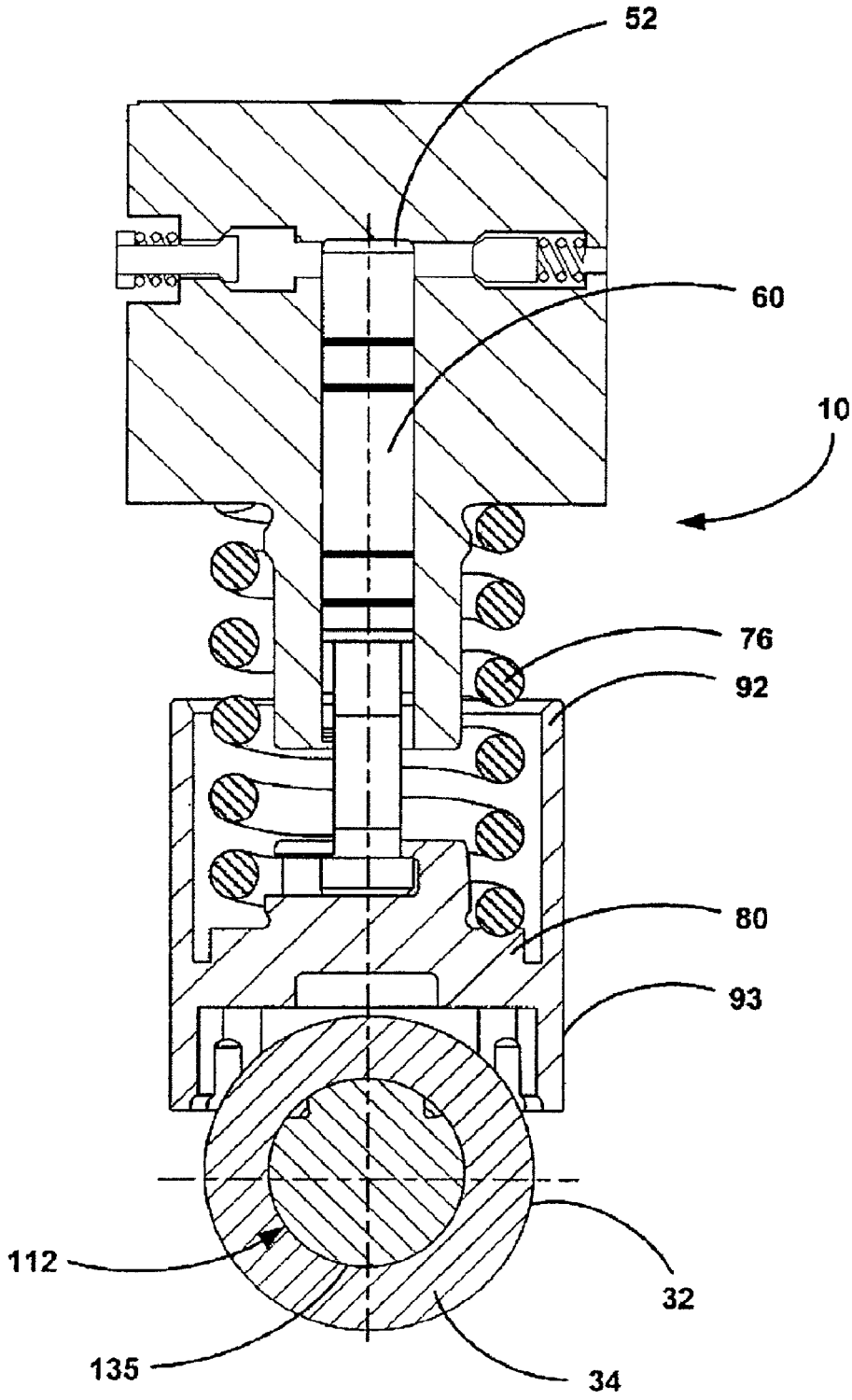
FIG. 1 is a cross-sectional illustration of an exemplary embodiment of a tappet assembly in which the present invention may operate.

A brief overview of a typical environment in which the invention operates shall be described to help in understanding the invention. Turning to the drawings, and particularly to FIG. 1, wherein like reference numerals refer to like elements, a tappet assembly 10, particularly suited for use in pumps to pressurize and pump fluid is illustrated. It is noted that the invention may be used in other operating environments. The tappet assembly 10 converts a rotational input motion to a linear fluid pumping action for the pump. Typically, the tappet assembly 10 is located and secured within a cylindrical bore of a pump housing. A single pump may include a plurality of tappet assemblies secured therein to provide a sufficient outflow rate for a given application.

As is well known in the art, to convert the rotational motion to a linear motion, the pump includes a rotatable camshaft having a lobe that extends radially outward from the camshaft. The lobe has an eccentric radial profile. In other words, each lobe has a non-circular or non-concentric cross-section. The linear output of the camshaft is characterized by the radial variation of the lobe. Thus, the difference between the minimum radius establishing the lobe's periphery and the maximum radius establishing the lobe's periphery determines the amount of linear motion that the camshaft provides.

The cam roller 34 of the tappet assembly 10 rides on the outer surface of the lobe as the camshaft rotates, and the lobe imparts at least a radial load on the cam roller 34 causing the cam roller 34 to move away from the camshaft, providing an input for the fluid pumping action of the tappet assembly 10. During operation, a plunger 60 actuated by the tappet assembly 10 moves "up and down" relative to and within a pumping chamber 52 with the cam roller 34 as the cam roller 34 moves "up and down" in response to the rotation of the lobe, thereby drawing fluid into the pumping chamber 52 on a "downward" motion, and pressurizing and pumping the fluid out of the pumping chamber 52 on an "upward" motion.

A coil spring 76 provides means for actuating the plunger 60 vertically downward during the downward stroke during which the plunger 60 draws fluid into the pumping chamber 52.

As will be appreciated, the plunger 60, coil spring carrier 80, and tappet 92 are in fixed vertical relation to one another such that all the components move vertically upward and downward, during the cyclical motion of the tappet assembly 10, substantially in unison.

The housing of the pump slidingly receives the tappet 92. To reduce friction, the outer surface 93 of the tappet 92 includes an annular lubrication groove 94 to provide lubrication between the tappet 92 and the pump housing, when inserted therein. The tappet 92 also includes an anti-rotation slot 95 in a side wall to prevent the tappet 92 from rotating relative to the pump housing.

Figure 2:
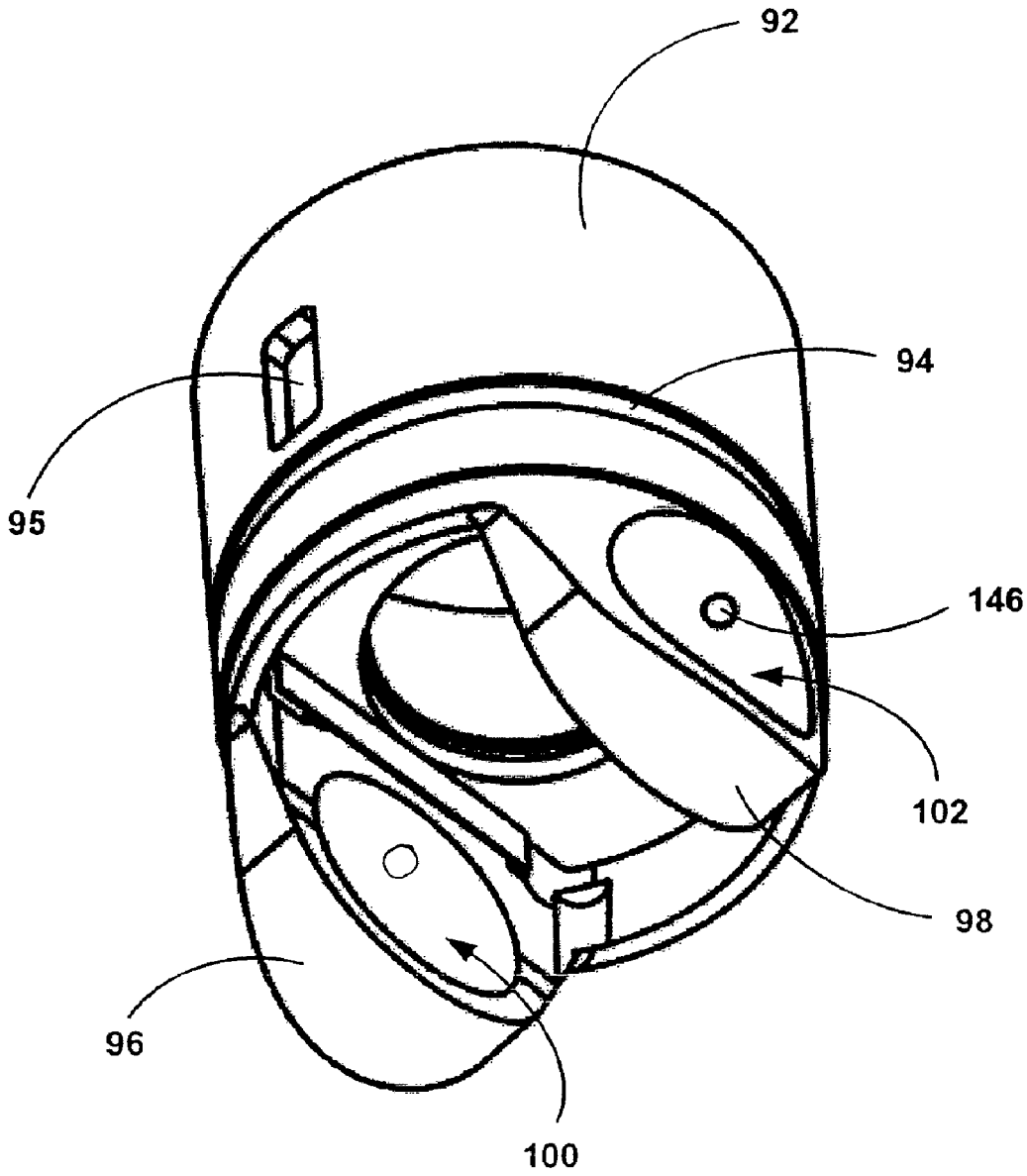
FIG. 2 is a perspective view of a tappet of the tappet assembly of FIG. 1.
Figure 3:
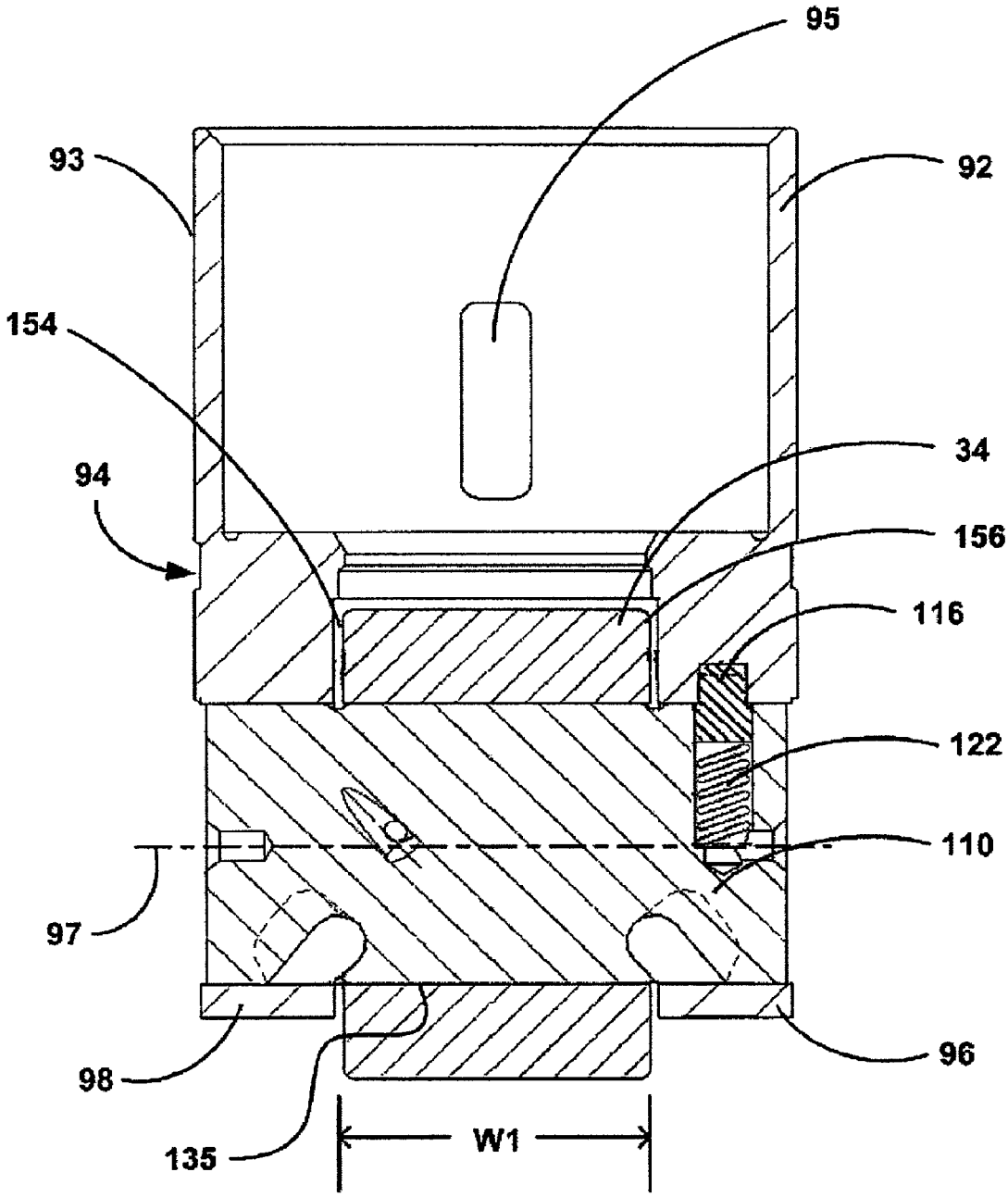
FIG. 3 is a cross-sectional illustration of tappet of the tappet assembly of FIG. 1 having a roller pin secured thereto and carrying a cam roller.

With further reference to FIGS. 2 and 3, the tappet 92 includes first and second roller pin mounts 96 and 98. The first roller pin mount 96 includes a first roller pin receiving hole 100 and the second roller pin mount 98 includes a second roller pin receiving hole 102. Each roller pin receiving hole 100 and 102 is adapted to receive a roller pin 110 that rotatably carries the cam roller 34. The roller pin 110 secures the cam roller 34 to the tappet 92 between the first and second roller pin mounts 96 and 98. The roller pin 110 inserts into the roller pin receiving holes 100 and 102 as well as a central bore 112 (see FIG. 1) in the cam roller 34. The outside diameter of the roller pin 110 is closely sized to the inside diameter of the cam roller 34 to provide limited slop between the two components. The roller pin 110 translates the loading applied to the cam roller 34 by the camshaft to the tappet 92.

Referring to FIG. 3, a bolt 116 secures the roller pin 110 within the roller pin receiving holes 100 and 102 of the roller pin mounts 96 and 98. The bolt 116 also prevents the roller pin 110 from rotating about its axis 97, which is also the axis of rotation for the cam roller 34. The bolt 116 is slidingly carried in a radially extending cavity in the roller pin 110 and extends out of the cavity of the roller pin 110 such that it extends through a corresponding cavity in the tappet 92. A spring 122 located within the cavity of the roller pin 110 biases the bolt 116 away from the central axis 97 of the roller pin 110 and into the cavity of the tappet 92. By extending into both the tappet 92 and the roller pin 110, the bolt 116 prevents the roller pin 110 from rotating or moving axially relative to the tappet 92.

Figure 4:
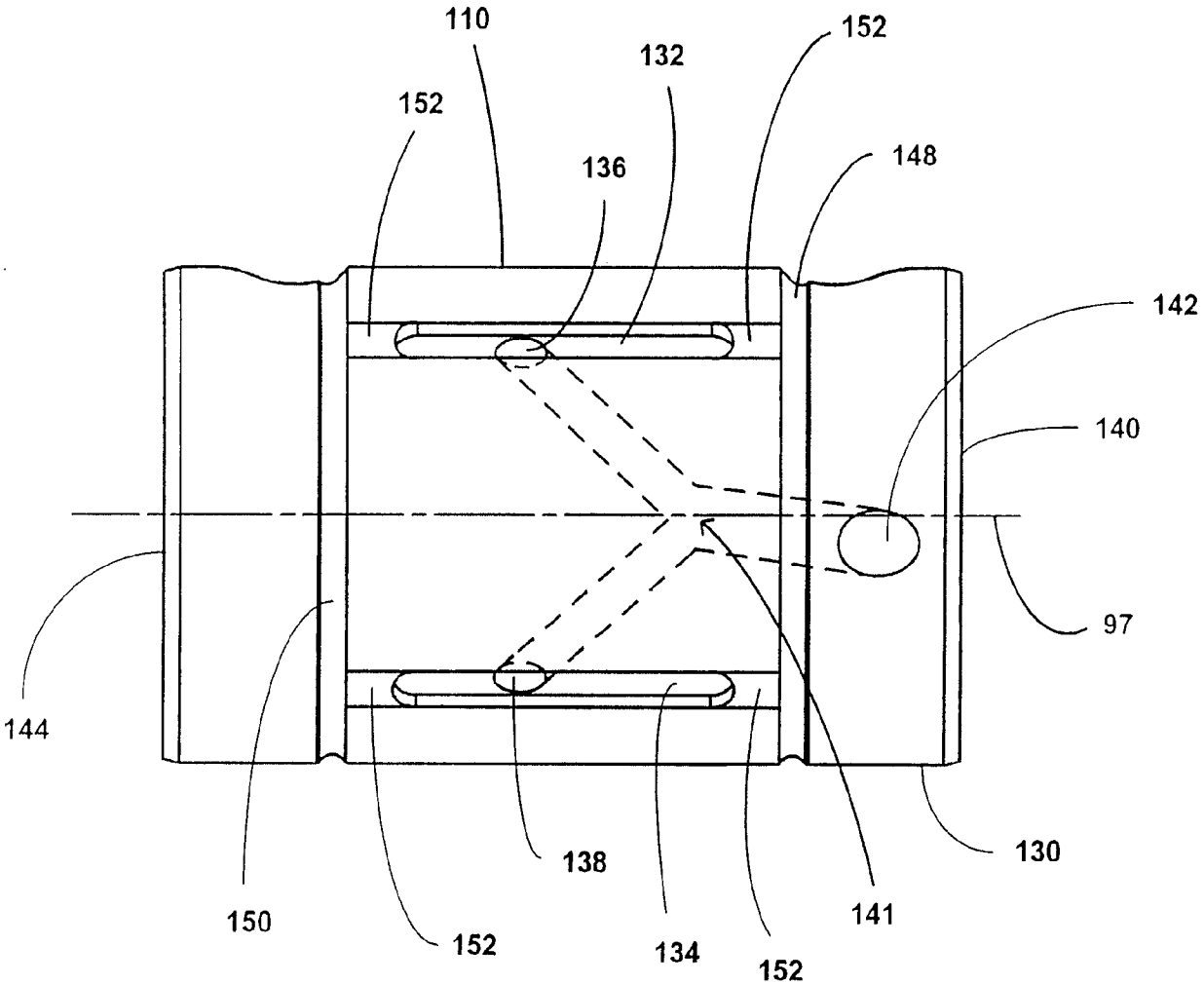
FIG. 4 is a plan view of the roller pin of the tappet assembly of FIG. 1.

Referring to FIG. 4, in an embodiment, the surface 130 of the roller pin 110 includes a pair of axially extending wells 132 and 134 which hold and deliver lubrication for lubricating the interface 135 (see FIG. 3) between the cam roller 34 and the roller pin 110. In alternative embodiments, the surface 130 could include a single well or more than two wells depending on the application. In the illustrated embodiment, the wells 132 and 134 are generally angularly spaced apart and substantially parallel. Each well 132 and 134 includes a lubrication port 136 and 138, respectively. The lubrication ports 136 and 138 extend into the roller pin 110. Each lubrication port 136 and 138 extends substantially radially inward towards the central axis 97 as well as cants relative to the central axis 97 such that each port 136 and 138 extends axially towards a first end 140 of the roller pin 110 when moving in a radially inward direction (from the surface 130 to the central axis 97). The lubrication ports 136 and 138 intersect and fluidly communicate with one another within the roller pin 110 at intersection 141.

The roller pin 110 includes a lubrication supply port 142 that extends substantially radially inward towards the central axis 97 of the roller pin 110 as well as cants relative to the central axis 97 such that the lubrication supply port 142 extends axially towards a second end 144, opposite the first end 140, of the roller pin 110 when moving in a radially inward direction (from the surface 130 to the central axis 97). The lubrication supply port 142 intersects and fluidly communicates with the lubrication ports 136 and 138 at intersection 141. The lubrication supply port 142 fluidly communicates with a port 146 in the tappet 92, illustrated in FIG. 2, that connects to a lubrication supply (not shown). The lubrication pools within the wells 132 and 134 where it is used to lubricate the interface 135 (FIG. 3) between the cam roller 34 and the roller pin 110.

To further promote lubrication of the interface 135 between the roller pin 110 and the cam roller 34, the outer surface 130 of the roller pin 110 includes first and second axially spaced apart annular channels 148 and 150. These channels 148 and 150 are spaced apart substantially the axial width, indicated as w1 in FIG. 3, of the cam roller 34 such that the first channel 148 aligns with a first axial end 154 of the cam roller 110 and the second channel 150 aligns with an opposite second axial end 156 of the cam roller 110.

As shown in FIG. 4, these annular channels 148 and 150 are in fluid communication with the axially extending lubrication wells 132 and 134 via shallow well extensions 152. The well extensions 152 allow lubricating fluid to flow from the lubrication wells 132 and 134 to the annular channels 148 and 150.

The well extensions 152 may be provided by flat spots on the outer surface 130 of the roller pin 110 or by grooves having shallower depths than the lubrication wells. Alternatively, the lubrication wells 132 and 134 could axially extend to the annular channels 148 and 150.

The roller pin of the present invention reduces and/or eliminates the high localized contact pressure at the edges of the cam roller, which, in previous tappet assemblies, caused the inner surface of the cam roller at the localized area of high contact pressure and corresponding outer surface of the roller pin to wear at a higher rate than the axially inner portion of the interface of the cam roller and roller pin.

Figure 5:
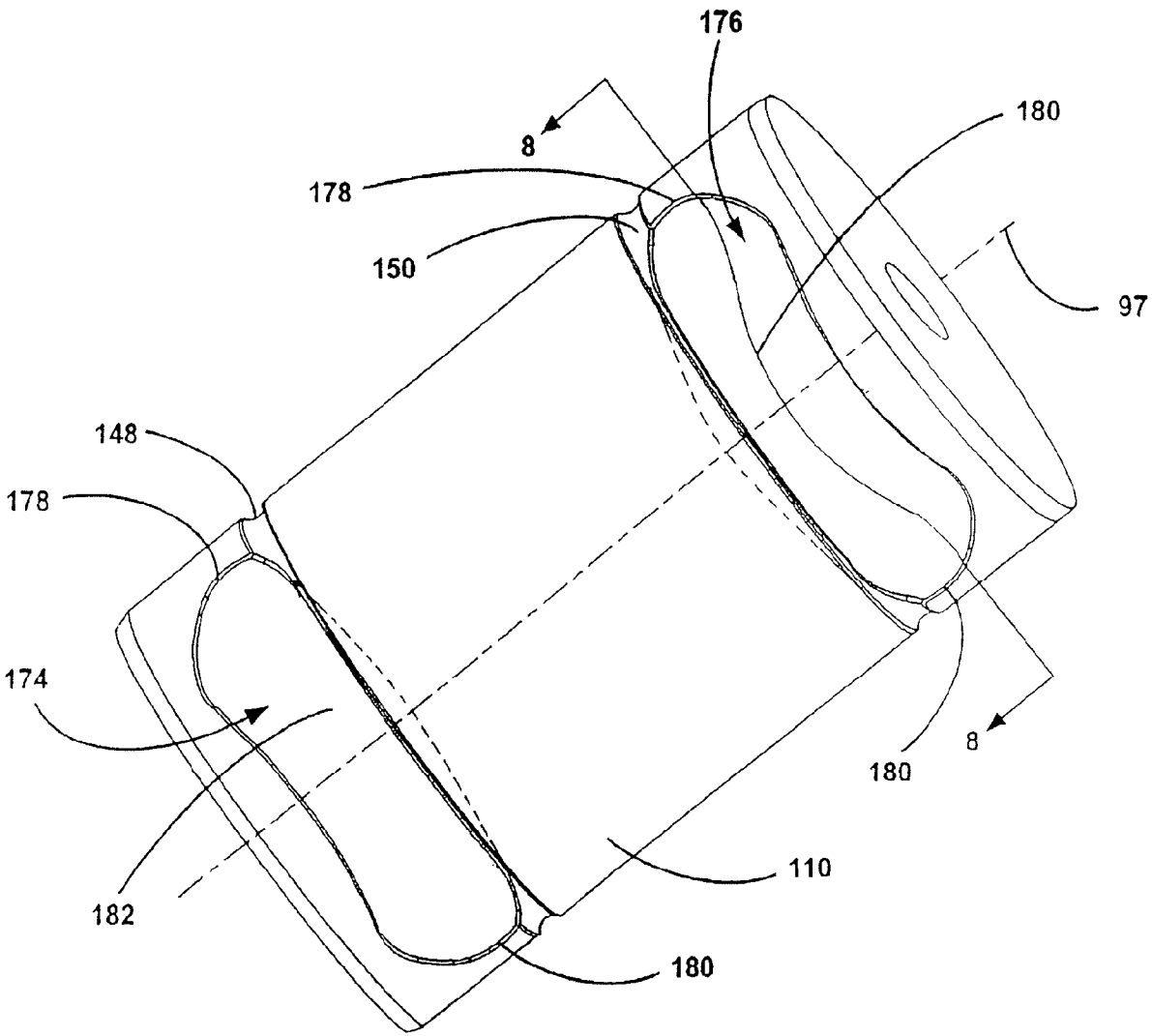
FIG. 5 is a bottom view of the roller pin of FIG. 4.
Figure 6:
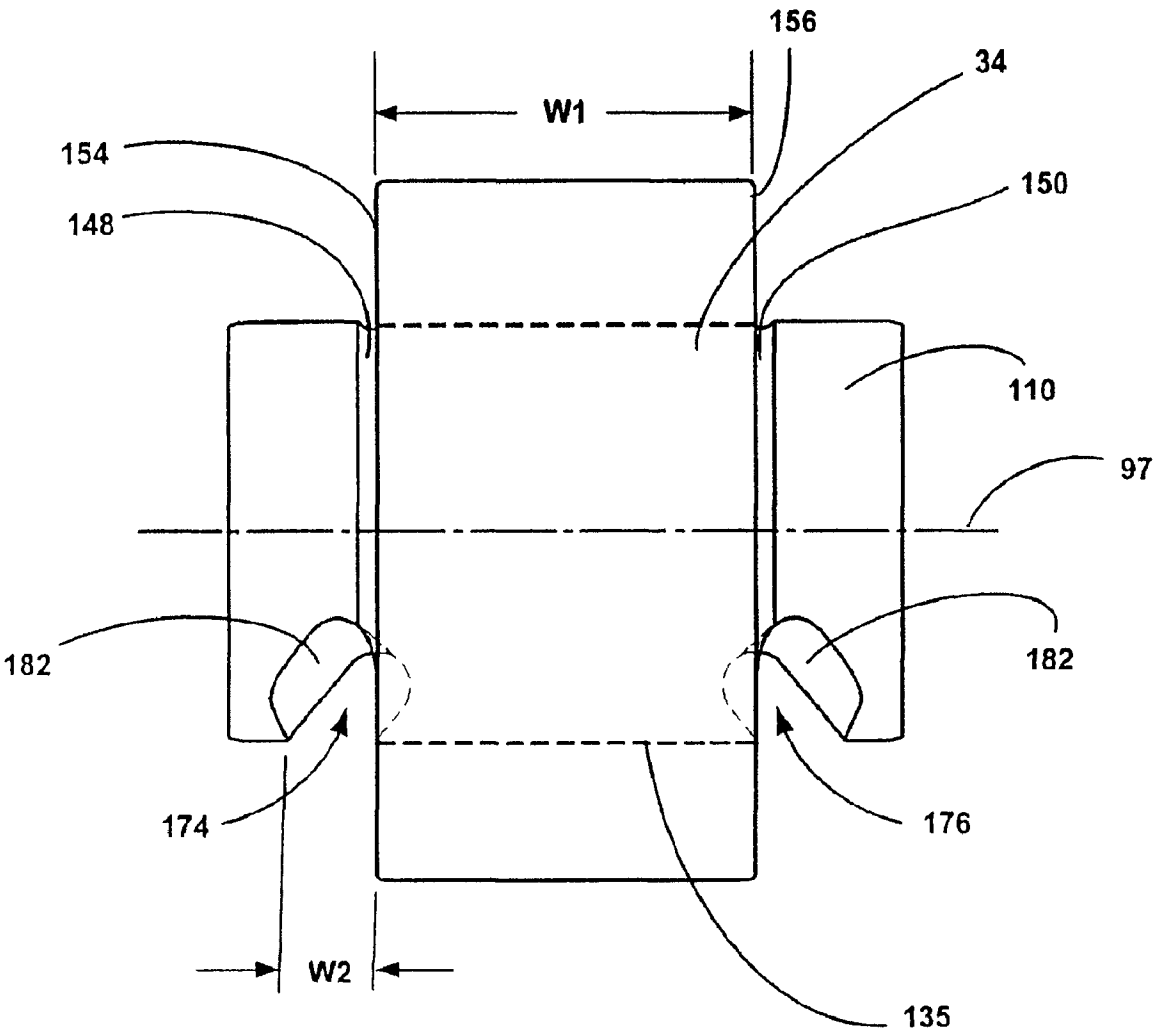
FIG. 6 is a profile view a cam roller carried on the roller pin of FIG. 5, illustrating the transverse grooves in the roller pin in accordance with the present invention.
Figure 7:
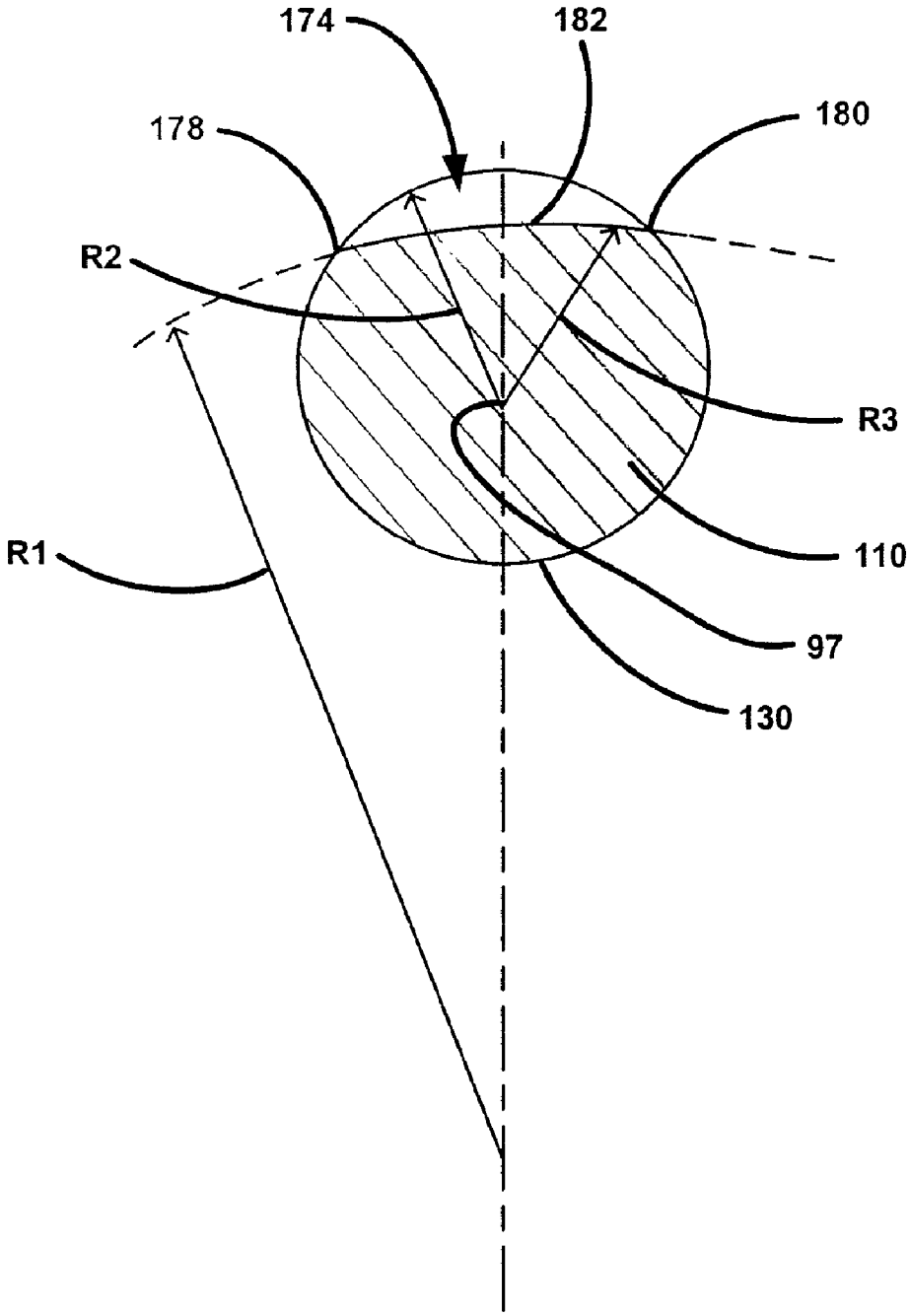
FIG. 7 is a simplified cross-sectional illustration of the roller pin of FIG. 6 about section line 8-8, substantially illustrating the curvature of the grooves of the roller pin in accordance with the present invention.
Figure 8:
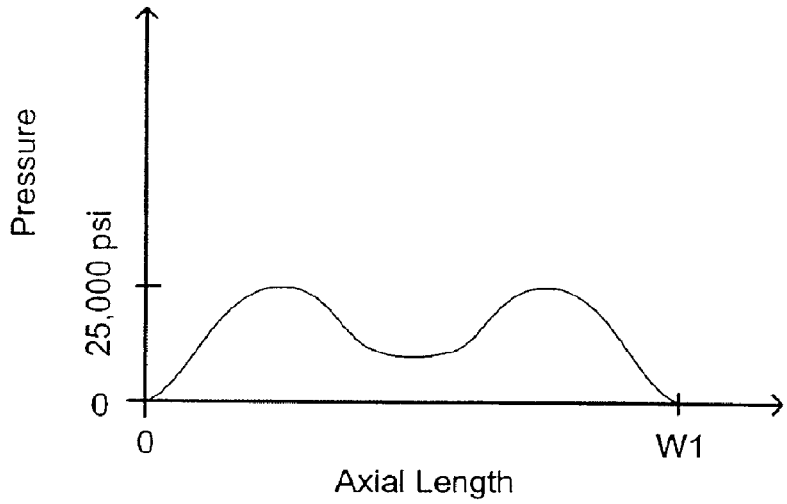
FIG. 8 is a graph of the contact pressure between the cam roller and roller pin of the present invention, illustrating the reduced maximum contact pressure and reduced localized contact pressure.
Figure 9:
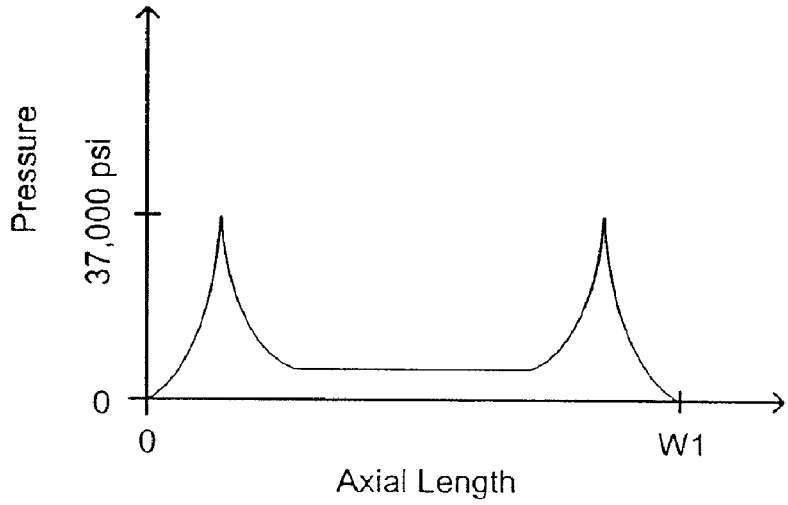
FIG. 9 Prior Art
FIG. 9 is a graph of the contact pressure between a cam roller and roller pin of the prior art, illustrating the extreme localized high contact pressure near the edges of the contact area.

Turning now to FIGS. 5-7, the roller pin 110 of the present invention includes a pair of grooves 174, 176 that are used to significantly reduce the non-uniform contact pressure as well as the associated localized high contact pressure between the cam roller 34 and the roller pin 110. Without the grooves 174, 176, high contact pressure exists at locations between the roller pin outer diameter and the cam roller inner diameter. The grooves 174, 176 are placed at these locations to promote more uniform compliance between the cam roller 34 and the roller pin 110, particularly near the axial ends 154 and 156 of the cam roller 34. The roller pin outer diameter is able to flex inward at the location of the grooves 174, 176 without weakening the overall stiffness of the roller pin to any great extent. Furthermore, the grooves 174, 176 facilitate localized compliance (i.e., flexibility) of the roller pin 110 near the edges of the interface 135. By making the contact pressure across the contact area more uniform, the peak contact pressure experienced at any localized area of the contact area is reduced (see FIG. 8, which is a graph of contact pressure between the cam roller and roller pin of the present invention).

In the embodiment shown in FIGS. 5 and 6, the grooves 174, 176 are elongated in a direction transverse to the central axis 97 of the roller pin 110. Additionally, the grooves 174, 176 extend axially towards each other and undercut the outer periphery of the roller pin 110 forming hollowed cavities under the outer periphery of the roller pin 110 as illustrated by the dashed lines in FIGS. 5 and 6. Furthermore, the axially inner edges of the grooves 174, 176 that intersect the outer periphery of the roller pin 110 are entirely contained within individual planes extending perpendicularly to the central axis 97 of the roller pin 110.

With reference to FIGS. 5-7, the grooves 174, 176 generally do not extend angularly around the entire circumference of the roller pin 110, i.e. each groove 174, 176 extends angularly between a first groove end 178 and second groove end 180. In the illustrated embodiment, the grooves 174, 176 are circumferentially centered about a vertical plane including the central axis 97 of the roller pin 110. Thus, the grooves 174, 176 are centered on the contact area 135 between the cam roller 34 and roller pin 110 when the lobes of the camshaft are at top-dead-center or top-dead-bottom. However, in other embodiments, the roller pin 110 can be positioned within the tappet 92 (see FIGS. 1 and 3) such that the grooves 174, 176 are offset from the vertical plane depending on the position of the maximum contact pressure and the direction of rotation of the camshaft.

As best illustrated in the embodiment shown in FIG. 7, the grooves 174, 176 are generally arcuate, and at least a portion of the bottom surface 182 of the grooves 174, 176 has a radius of curvature R1 that is larger than the radius R2 of the roller pin 110. Because the radius of curvature R1 is greater than radius R2, the radial distance R3 from the central axis 97, which is perpendicular to the page in FIG. 7, of the roller pin 110 to the bottom 182 of the grooves 174, 176 continuously varies angularly from the first groove end 178 to the second groove end 180. It will appreciated that as the radius of curvature R1 approaches infinite, the bottom 182 of the grooves 174, 176, will approach a horizontal line defining a chord of the circumference of the roller pin 110.

In an embodiment, the maximum depth of the grooves 174, 176, i.e. the value of R2 minus the minimum value for R3, is significantly deeper than the depth of the annular lubrication grooves 148 and 150. In an embodiment the depth of the grooves 174, 176 is between about 15 to 20 percent of the diameter of the roller pin 110 at its deepest. Furthermore, the grooves 174, 176 do not function to facilitate lubrication between the cam roller 34 and the roller pin 110. The width, w2, of the grooves 174, 176 may vary as a function of angular position from the first groove end 178 to the second groove end 180. The width w2 of the grooves 174 and 176 may also vary as a function of radial position from the outer surface 130 of the roller pin 110 to the bottom 182 of the grooves 174, 176.

The grooves 174, 176 eliminate the end loading of the cam roller inner diameter to the roller pin outer diameter. Additionally, elimination of the end loading and moving of the peak contact pressure inboard and away from the roller ends allows for higher load carrying capacity for the cam roller. As a result, the roller pin 110 may be made from steel material and the like instead of brass material, thereby increasing the durability of tappet assembly. Additionally, the grooves 174, 176 reduce, and in some instances, eliminate the need for the pump run-in operation previously described.

One benefit of the grooves is that unlike a worn-in roller pin, the grooves flex in proportion to the applied load, thereby providing proper contact pressure at the ends of the roller pin for all operating loads. A worn-in roller pin, on the other hand, only provides proper end loading only at a single operating load with the end loads going lower or higher as the roller loads are lower or higher, respectively.

Another benefit of the grooves is that the resulting proper contact pressure across the full width of the roller pin helps prevent the roller pin from becoming unstable and chattering in a manner that can cause axial thrust loads and increased wear rates.

The moving of the peak contact pressure inward and away from the roller ends results in the load being supported where a proper EHD (elastrohydrodynamic) bearing fluid film can be generated. Additionally, the grooves provide increased EHD fluid film thickness at each end of the roller pin to prevent seizure of the cam roller to the roller pin.

Furthermore, the grooves 174, 176 add local compliance to the roller pin outer diameter in the area of the end contact loading such that the bending curvature of the cam roller and the roller pin match when the roller bending curvature is reduced at each end of the roller.

While the grooves 174, 176 have been illustrated and described above as being disposed axially inward from the ends of the roller pin 110, in an alternative embodiment, the grooves 174, 176 are formed at and intersect the ends of the roller pin such that the grooves form a stepped profile in the roller pin.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A roller pin for carrying a cam roller in a tappet assembly, comprising:

a substantially cylindrical shaft having a length, a first end and a second end; and a plurality of grooves in the shaft axially spaced apart and extending in a direction being transverse to the length, the plurality of grooves located proximate the first and second ends and extending only partially the circumference of the shaft; and wherein the shaft includes a lubrication flow passage having an inlet in an outer surface of the shaft and at least one outlet in an outer arcuate surface of the shaft, the at least one outlet in fluid communication with at least one axially extending well in the outer arcuate surface of the shaft.

2. The roller pin of claim 1 wherein the shaft includes at least one annular channel in the outer surface of the shaft, one of the at least one annular channels axially positioned between the inlet and the at least one axially extending well.

3. The roller pin of claim 1 wherein the shaft includes a radially extending bolt carrying chamber.

4. The roller pin of claim 1 wherein the shaft is steel.

5. A roller pin for carrying a cam roller in a tappet assembly, comprising:

a substantially cylindrical shaft having a length, a first end and a second end;

a plurality of grooves in the shaft axially spaced apart and extending in a direction being transverse to the length, the plurality of grooves located proximate the first and second ends and extending only partially the circumference of the shaft; and wherein the depth of each of the grooves continuously varies from a first end of the groove to a second end of the groove.

6. The roller pin of claim 5 wherein at least a portion of a bottom of each groove has a radius of curvature that is larger than a radius of the shaft.

7. The roller pin of claim 5 wherein the maximum depth of the groove is at least 15 percent the diameter of the shaft.

8. The roller pin of claim 5 wherein the grooves are arcuate.

9. The roller pin of claim 5 wherein a portion of each of the grooves undercuts an outer periphery of the shaft.

10. The roller pin of claim 9 wherein the axially inner edges of the grooves are substantially contained within a plane extending perpendicularly to a central axis of the shaft.

11. A tappet assembly for use in a pump, the tappet assembly comprising:

a tappet having a first roller pin mount and a second roller pin mount, each of the first and second roller pin mounts having a receiving hole;

a roller pin, the roller pin inserted within the receiving holes, the roller pin including a plurality of axially spaced apart grooves that extend in a transverse direction relative to a length of the roller pin, the grooves extending only partially around the circumference of the roller pin; and a roller carried on the roller pin; and wherein the roller pin includes a lubrication flow passage having an inlet in an outer surface of the roller pin and at least one outlet in an outer arcuate surface of the roller pin, the at least one outlet in fluid communication with at least one axially extending well in the outer arcuate surface of the roller pin, and the inlet is in fluidic communication with a lubrication supply port in the tappet.

12. The tappet assembly of claim 11, wherein the roller pin includes at least one annular channel in the outer surface of the roller pin, one of the at least one annular channel positioned axially between the inlet and the at least one axial extending well.

13. The tappet assembly of claim 12, wherein the roller has a length and the at least one annular channel is axially spaced apart substantially the length, and the plurality of axially spaced apart grooves are axially spaced apart substantially the length.

14. A tappet assembly for use in a pump, the tappet assembly comprising:

a tappet having a first roller pin mount and a second roller pin mount, each of the first and second roller pin mounts having a receiving hole;

a roller pin, the roller pin inserted within the receiving holes, the roller pin including a plurality of axially spaced apart grooves that extend in a transverse direction relative to a length of the roller pin, the grooves extending only partially around the circumference of the roller pin;

a roller carried on the roller pin; and wherein the grooves are axially spaced apart such that the grooves align with axial ends of the roller forming a stepped profile in the roller pin.

15. A tappet assembly for use in a pump, the tappet assembly comprising:

a tappet having a first roller pin mount and a second roller pin mount, each of the first and second roller pin mounts having a receiving hole;

a roller pin, the roller pin inserted within the receiving holes, the roller pin including a plurality of axially spaced apart grooves that extend in a transverse direction relative to a length of the roller pin, the grooves extending only partially around the circumference of the roller pin;

a roller carried on the roller pin; and wherein a portion of each of the grooves undercuts an outer periphery of the roller pin in a direction extending axially toward the other groove, and wherein axially inner edges of each of the grooves are substantially contained within a plane extending perpendicularly to a central axis of the roller pin.

* * * * *